US005647679A

United States Patent [19]

Green et al.

[11] Patent Number: 5,647,679

[45] Date of Patent: Jul. 15, 1997

[54] PRINTER FOR PRINTING ON A CONTINUOUS PRINT MEDIUM

[75] Inventors: Michael Cameron Green, Worth; Anthony James Palmer, Redhill; Alan Hall, Woking, all of England

[73] Assignee: ITW Limited, Windsor, United Kingdom

[21] Appl. No.: 625,854

[22] Filed: Apr. 1, 1996

[51] Int. Cl.[6] ..... B41J 33/14

[52] U.S. Cl. ..... 400/232; 400/120.16; 400/224.1; 400/225; 347/215; 347/217; 347/214

[58] Field of Search ..... 400/120.01, 120.16, 400/120.17, 224.1, 225, 229, 232, 236; 347/213, 214, 215, 216, 217, 218

[56] References Cited

U.S. PATENT DOCUMENTS

| | | | |
|---|---|---|---|
| 4,625,218 | 11/1986 | Watanabe | 347/217 |
| 4,642,656 | 2/1987 | Shibuya et al. | 347/215 |
| 5,001,498 | 3/1991 | Shimizu et al. | 347/215 |
| 5,121,136 | 6/1992 | Kawakubo | 347/215 |
| 5,153,606 | 10/1992 | Bas | 400/120.16 |
| 5,162,815 | 11/1992 | Hodge | 400/232 |
| 5,369,422 | 11/1994 | Yoshida et al. | 400/232 |
| 5,415,482 | 5/1995 | Poole et al. | 400/232 |
| 5,429,443 | 7/1995 | Kobayashi et al. | 400/232 |
| 5,478,159 | 12/1995 | Schneider et al. | 400/232 |
| 5,481,291 | 1/1996 | Ishida et al. | 347/217 |

FOREIGN PATENT DOCUMENTS

| | | | |
|---|---|---|---|
| 0387698 | 9/1990 | European Pat. Off. | 400/232 |
| 361135773A | 6/1986 | Japan | 347/215 |
| 0246272 | 10/1988 | Japan | 400/232 |
| 363270173A | 11/1988 | Japan | 347/217 |

*Primary Examiner*—Eugene H. Eickholt
*Attorney, Agent, or Firm*—Schwartz & Weinrieb

[57] ABSTRACT

A thermal printer for printing on a continuous print medium by ink transfer from a thermal print ribbon has a print head which is pivotally mounted and which is driven in an oscillatory nodding motion by a stepper motor so as to repeatedly to bring a linear array of energizable printing elements to bear against a platen roller. Both the element array and the platen extend transversely to respective paths of travel of the print medium and the ribbon. The print medium is fed through the printer from an inlet region, between the platen and print head, and thence to an outlet region. The instantaneous rate of travel of the print medium past the print head is substantially the same as the rate of feed of print medium to the printer. Typically this rate is of the order of 250 to 400 mm per second. The ribbon also travels between the print head and the platen, overlying the print medium and is driven in such a manner that it travels at the same rate as the print medium during each printing operation. This is achieved by driving the ribbon with a motor the speed of which is controlled according to the sensed speed of travel of the print medium, for example, by coupling the motor to processing circuitry which takes an input signal from a shaft encoder associated with the platen roller. Alternatively, the ribbon may be driven by frictional contact with the print medium. These methods of driving the ribbon have the advantage that the ribbon speed can be varied to take account of different print medium speeds, for example, due to the requirements of differing packaging processes, and also in response to transient variations in print medium speed during each printing operation.

25 Claims, 4 Drawing Sheets

PRINTER FOR PRINTING ON A CONTINUOUS PRINT MEDIUM

FIELD OF THE INVENTION

This invention relates to a thermal printer for printing on a continuous print medium by thermal ink transfer from a print ribbon.

BACKGROUND OF THE INVENTION

It is known to print continuous packaging material and other continuous print media such as label bearing substrates with alphanumeric information and other symbols using a thermal transfer printer. A print head having a row of electronically driven heating elements is brought to bear against an ink-carrying thermal transfer ribbon lying over the print medium while the print medium is driven perpendicularly to the row of print elements. In one known printer, the ribbon is supplied from a take-off spool and then passes along a ribbon path which extends between the print head and the path of the print medium, and thereafter is fed onto a take-up spool, the ribbon travelling across the print head at at least approximately the same speed as the print medium whilst printing is taking place. The path followed by the print medium extends around movable rollers which deflect the print medium by variable amounts both upstream and downstream of the print head. These rollers impose significant stresses on the print medium and complicate threading when the print medium is loaded into the printer. Such a printer operates typically at print medium speeds up to 200 mm per second.

OBJECT OF THE INVENTION

It is an object of this invention to provide a more reliable and faster printer for continuous printing.

SUMMARY OF THE INVENTION

According to a first aspect of this invention there is provided a thermal printer for printing on a continuous print medium by ink transfer from a thermal print ribbon, comprising means defining a print medium path between inlet and outlet regions of the printer, a platen extending transversely of the said path, a thermal print head having energizable print elements and located in an opposing relationship with respect to the platen on the other side of the print medium path from the platen, means defining a ribbon path which, between the print head and the platen, runs in the same direction as and lies adjacent to the print medium path, a printing actuator operable to bring the print head and the platen together in successive printing operations, and ribbon drive means operable to drive the ribbon along the ribbon path at variable rates during the printing operations, the print medium path defining means being arranged such that the print medium travels past the print head at an instantaneous rate which is substantially the same as that with which it enters the inlet region.

Preferably, the speed with which the ribbon is driven during each printing operation is variable in response to the print medium speed of travel so as to match the speed with which the print medium is fed past the print head. This may be achieved, for example, by forming the platen as a roller around which the print medium is wrapped so that the speed of rotation of the roller is a measure of the speed of passage of the print medium. A shaft encoder, typically an optical encoder, is used to provide an input to processing means forming part of the printing actuator to control movement of the print head and energization of the printing elements. In addition, the ribbon may be driven by a stepper motor coupled to a ribbon drive roller, the speed of operation of the stepper motor being governed by the sensed speed of rotation of the platen roller. Alternatively, the printer may be arranged such that the ribbon is pressed against the printing medium so that, providing the ribbon is fed from and taken up on spools at a sufficient rate, the speed of the ribbon across the print head during the printing operation is determined entirely by frictional drive from the print medium, no separate ribbon drive motor being required.

In this way it is possible to operate the printer over a wider range of speeds than prior art printers, with the print medium passing the print head at substantially the same rate as it is fed to and extracted from the printer. Typically, the printer is capable of operating at print medium speeds up to 400 mm per second. According to a method aspect, the invention includes a method of printing on a continuous print medium, comprising providing a printer having a print head with energizable print elements, and a platen, the print head and the platen being located in an opposing relationship with respect to each other, feeding a print ribbon to the printer at a continuous feed rate and passing it between the print head and the platen in the same direction as and adjacent to the print medium, feeding the print ribbon between the print head and the platen, and periodically bringing the print head and the platen together and energizing the print elements with the ribbon in contact with the print medium so as to cause transfer of ink from the ribbon to the print medium in a printing operation, wherein the print medium is passed between the print head and the platen at a rate corresponding to the rate at which the print medium is fed to the printer during and between successive printing operations and wherein, during each printing operation, the ribbon is passed between the print head and the platen in contact with the print medium, the rate at which the ribbon moves during the printing operation being variable in response to the rate of travel of the print medium in the printer.

The ribbon path may be defined by guides and, between the print head and the platen, runs in the same direction as and lies adjacent to the print medium path, the printing actuator being operable to move the print head towards and away from the platen in successive printing operations, to compress the ribbon and the print medium together along a line of printing elements on the printing head. The print head may be mounted on a print head carrier which is pivotable about an axis running transversely to the print medium path, the print elements being spaced from this axis so as to execute the above-mentioned movement towards and away from the platen as a nodding or pivotal motion.

The platen is preferably a roller having a diameter not greater than 20 mm.

Advantageously, the print head carrier is linked to the shaft of a stepper motor coupled to the printing actuator, with the printing elements spaced from the axis of rotation of the motor so that they follow an arcuate locus which passes through the surface of the platen roller at a location where it supports the print medium. Operation of the stepper motor over a small angular range successively in opposite directions moves the print head towards and away from the platen roller at the beginning and end respectively of each successive printing operation. Rigid coupling of the print head carrier to the motor shaft, for example, by means of cranks and a connecting rod or by direct co-axial connection, results in accurate positioning of the print head elements with respect to the print medium as it travels over the platen roller and with respect to the platen roller axis of rotation.

The invention also includes, according to a third aspect thereof, a printer for printing on a continuous print medium by ink transfer from a print ribbon, comprising means defining a print medium path, a platen extending transversely of the path, a print head having energizable print elements and located in an opposing relationship with the platen on the other side of the print medium path from the platen, means defining a ribbon path which, between the print head and the platen, runs in the same direction as and lies adjacent to the print medium path, a ribbon take-off spool, a ribbon take-up spool which is belt driven by means of a slipping clutch drive, and a printing actuator operable to bring the print head and the platen together in successive printing operations.

The printer may further comprise a ribbon drive pulley located in the ribbon path between the print head and the take-up spool, and a ribbon drive motor coupled to the drive pulley, the take-up spool being belt-driven by the said motor. The take-up spool may be belt-driven directly from the print medium or from the roller driven by the passage of the print medium. Thus, the belt drive may include a driven roller arranged to bear against either the print medium where it lies over the platen or an alternative supporting surface, or against a roller which is rotated by the passage of the print medium. The driven roller may be mounted on the print head carrier so as to drive the take-up spool only during a print operation, that is, when the print head bears against the ribbon, the print medium and the platen.

The invention is applicable primarily to printing variable information on continuous plastic film packaging material, with each print operation being triggered by, for example, sensing the position of products to which the packaging material is to be applied as they travel along an adjacent conveyor. Typically, the information includes sell-by dates, serial numbers, pricing information, and bar codes.

BRIEF DESCRIPTION OF THE DRAWINGS

The invention will be described below by way of example with reference to the drawings in which like reference characters designate like or corresponding parts throughout the several views, and wherein.

DETAILED DESCRIPTION OF THE ILLUSTRATED EMBODIMENTS

Figure 1:
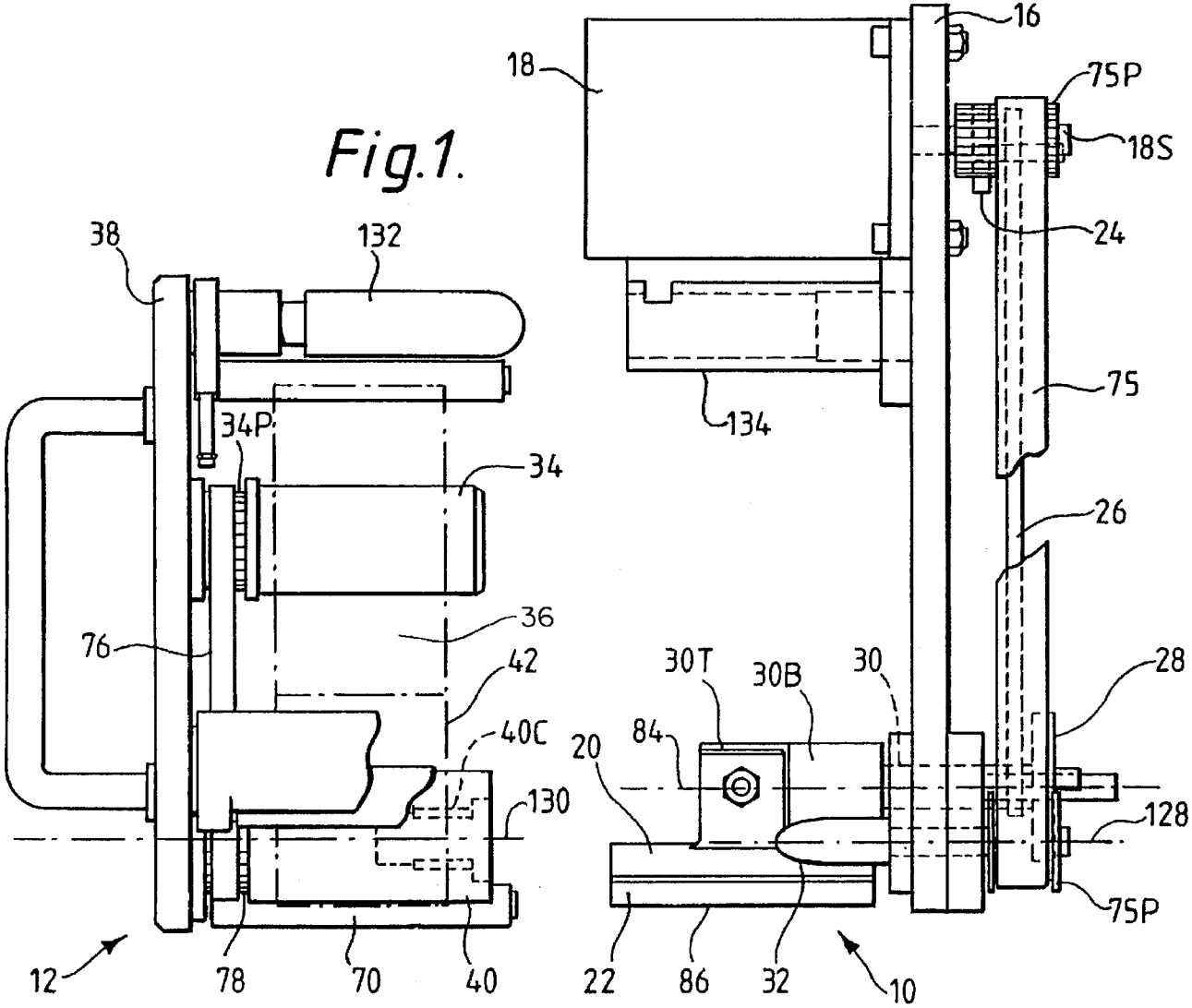
FIG. 1 is a diagrammatic exploded side view of a printer in accordance with the invention.
Figure 2:
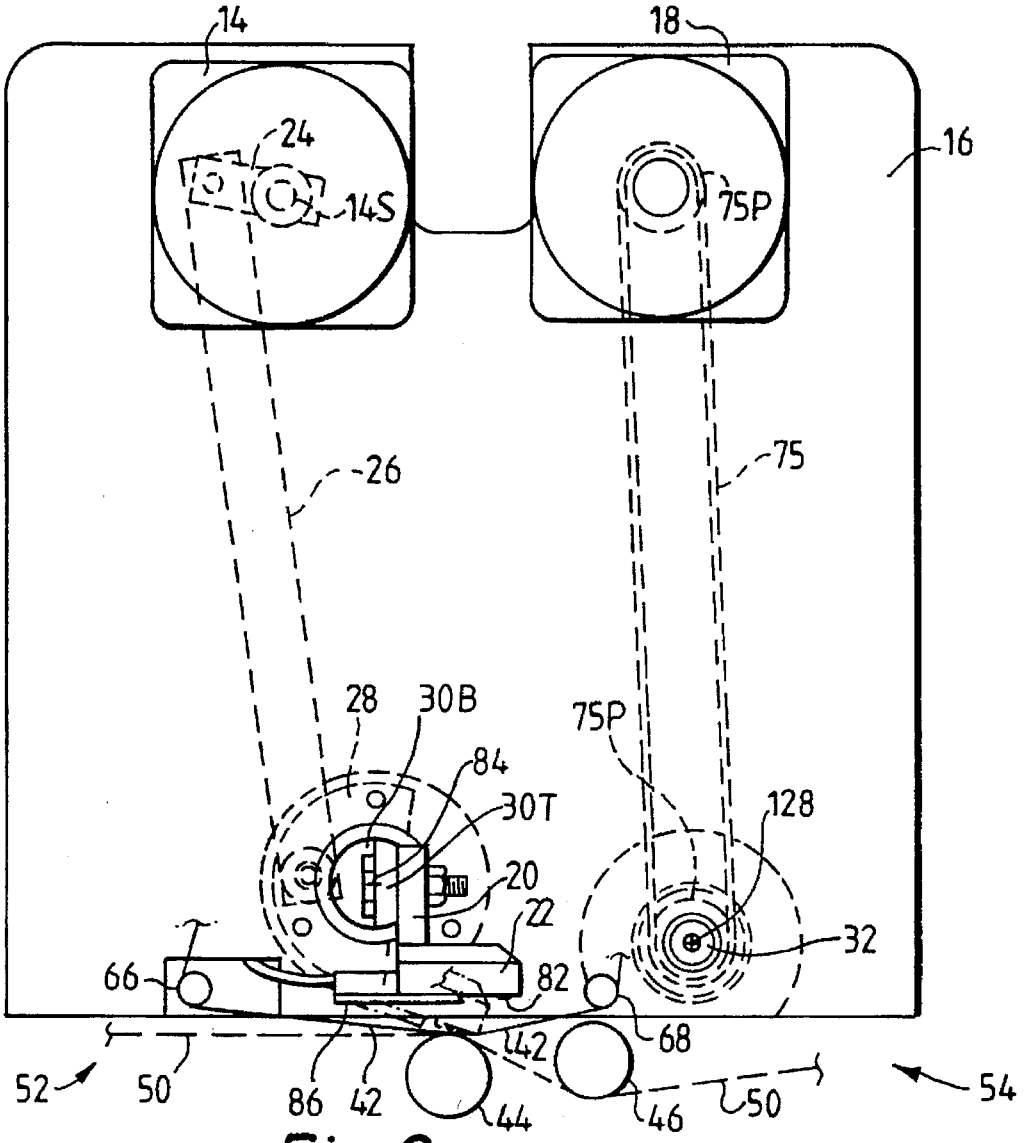
FIG. 2 is a front view of a base unit printer of FIG. 1.
Figure 3:
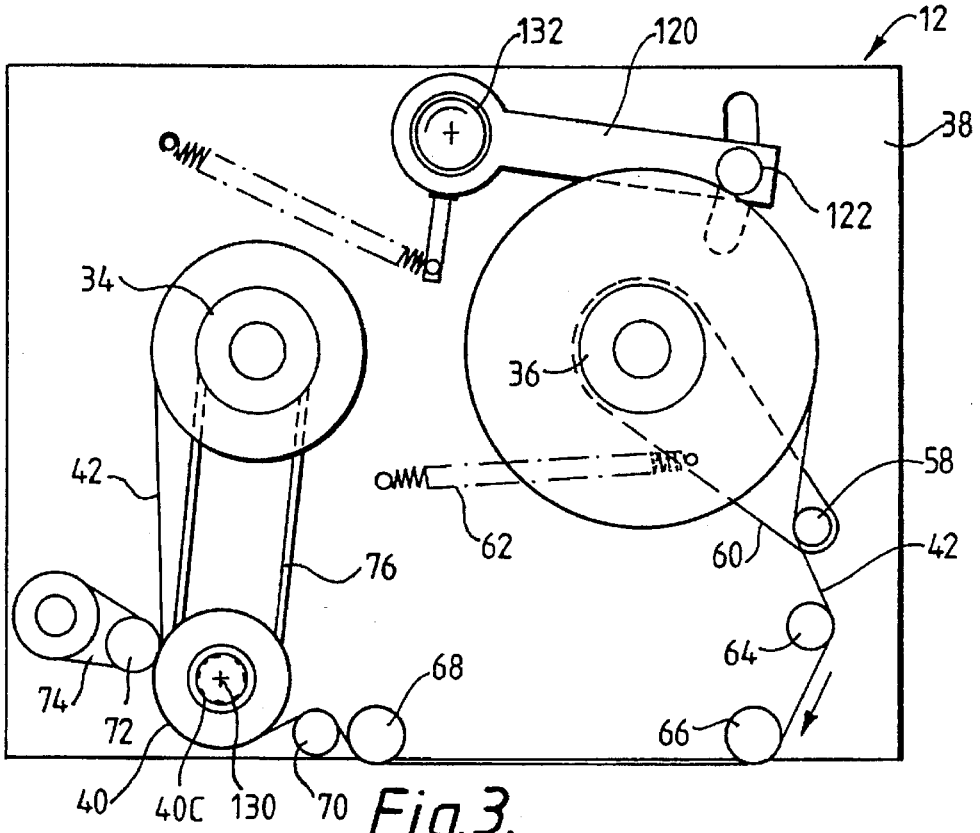
FIG. 3 is a rear view of a ribbon cassette of the printer of FIG. 1.

Referring to FIGS. 1, 2 and 3 together, a printer for the continuous printing of a continuous print medium by transfer from a thermal transfer print ribbon has a base unit 10 and a removable ribbon cassette unit 12. The base unit, which is mounted to a frame of the printer (not shown), contains a print head stepper motor 14 mounted on a front plate 16 of the unit 10, and a ribbon drive stepper motor 18 similarly mounted on the front plate 16. Coupled to the motor shaft 14S of the print head stepper motor 14 is a pivotable print head carrier 20 which supports a print head 22.

Coupling of the print head carrier 20 to the motor shaft 14S is by way of a parallelogram linkage lying behind the front plate 16 and comprising a first crank 24 fixed to the motor shaft 14S, a connecting link or rod 26, and a second crank 28 generally in the form of a semi-circular plate which is mounted on a shaft 30 supporting the print head carrier 20. Shaft 30 takes the form of a boss 30B on the front side of plate 16, with an axially extending tongue 30T to which the print head carrier 20 is bolted.

The motor shaft 18S of the ribbon drive stepper motor 18 is attached to a drive spindle 32 which, like the print head carrier 20, projects perpendicularly from the front plate 16 of the base unit 10.

For clarity, the cassette unit 12 is shown in FIG. 1 spaced from the base unit 10. In practice, when fitted to the base unit 10, the cassette unit 12 is closer to the base unit 10, such that ribbon spools 34, 36, which are rotatably mounted on a from plate 38 of the cassette unit 12, are coextensive with the print head 22 in terms of their location in a direction perpendicular to the front plate 38 of the cassette unit 12. Also attached to the cassette unit front plate 38 is a ribbon drive roller 40 visible in FIG. 1 below ribbon spool 34, and also in FIG. 3.

The relative positioning of the ribbon spools 34, 36, the prim head 22, and the ribbon drive roller 40 may be ascertained by comparison of FIG. 1 with FIG. 3. The ribbon 42 itself is shown in full lines in FIG. 3, but in phantom lines in FIG. 1 for clarity. Certain items shown in FIG. 1 are not shown in FIG. 2, and vice versa. In particular, a platen roller 44 and a deflection roller 46 are shown in FIG. 2 but not in FIGS. 1 and 3. These components are mounted on the printer frame or other apparatus with which the printer is associated.

Referring to FIG. 2, continuous film material to be printed, shown by reference numeral 50, enters the printer in an inlet region 52, passes over and wraps around platen roller 44 from which it follows a downwardly inclined path so as to pass underneath and wrap around the deflection roller 46 before passing to an outlet region 54 of the printer. The positioning of platen and deflection rollers 44 and 46 is such that the film substrate 50 is nowhere deflected through an angle greater than 60° by any one guiding element, and preferably not greater than 45°. The function of the deflection roller 46 may be performed instead by any deflecting support for the film substrate 50 positioned to cause the substrate to be wrapped partly around the platen roller 44. Both platen roller 44 and deflection roller 46 have axes of rotation which extend at right angles to the direction of travel of the substrate film 50, and both axes are fixed in position so that the path of the substrate film 50 remains substantially constant during and between successive printing operations. As a result, the instantaneous rate at which the film 50 passes over the platen roller 44 always matches the rate at which it is supplied to and extracted from the printer through the inlet and outlet regions 52 and 54.

The thermal transfer ribbon 42 follows a ribbon path as follows. Firstly, a supply of the ribbon 42 is provided from a feed spool 36 which is mounted by means of a bearing (not shown) fixed to the cassette unit front plate 38. A degree of friction is built into this bearing so as to maintain tension in ribbon 42. From spool 36, the ribbon 42 passes over a break detector roller 58 attached to the end of a break detector arm 60 which is rotatable about the rotation axis of the feed spool 36 and biased in a clockwise direction as seen in FIG. 3 by a spring 62. From roller 58, the ribbon 42 passes over guide rollers 64 and 66 attached to the cassette unit front plate 38 and thence through a region which, when the cassette unit 12 is loaded into the base unit 10, lies between the print head 22 and the platen roller 44. The ribbon 42 then passes over a further guide roller 68. The print head 22 and the platen roller 44 are seen in FIG. 2, as are also guide rollers 66 to 68, so that the location of the ribbon path relative to the print head 22 and platen roller 44 can be seen. Where the ribbon 42 passes over platen roller 44 it is in frictional contact with the substrate film 50. The ribbon 42 is held in contact with substrate film 50 only between the start and finish of each printing operation, during which the lower surface of the print head 22 bears against the platen roller 44 through the ribbon 42 and film 50, as shown in FIG. 2. At other times, the print head 22 is raised by operation of its stepper motor 14.

From the print head 22, the ribbon 42 travels over guide roller 70 and is then wrapped around the drive roller 40. A pinch roller 72, mounted on a pivotable support arm 74, maintains the ribbon 42 in gripping contact with drive roller 40. Drive roller 40 has a rubber sleeve and is driven by motor 18 by means of a toothed belt 75 and toothed pulleys 75P mounted behind base unit front plate 16 2nd on the motor shaft 18S and the spindle 32, (shown in FIGS. 1 and 2) so that the ribbon 42 is pulled through the space between the print head 22 and the platen roller 44. From the drive roller 40, the ribbon 42 passes to the take-up spool 34 which is belt-driven by a belt 76 from a pulley 78 (see FIG. 1) mounted on the shaft of drive roller 40. The mounting bearing (not shown) of the take-up spool 34 is mounted on a shaft fixed to the cassette unit front plate 38 and, like the mounting bearing of the feed spool 36, has a degree of friction built in. The diameter of the pulley 34P associated with take-up spool 34 together with the diameter of the pulley 78 associated with drive roller 40 are such that the shaft bearing the take-up spool 34 is always driven faster than the speed of rotation necessary to take up the ribbon 42 from the drive roller 40, regardless of the diameter of the ribbon reel. The friction slip built into the connection between spool 34 and the belt-driven shaft allows the respective speeds of rotation of the drive roller 40 and the take-up spool 34 to be different from each other.

The print head 22 has side-facing printing elements 82 (FIG. 2) extending along a line parallel to the axis of rotation 84 of the print head carrier 20. These printing elements 82 project from a lower surface 86 of the print head 22 which, in the printing position of the print head 22, is tangential to the platen roller 44, as shown by the chain lines in FIG. 2. The arcuate locus followed by the line of printing elements 82 when the print head 22 is pivoted about axis 84 passes through the intersection of a tangent parallel to the print head lower surface 86 and the platen roller surface. Consequently, the ribbon 42 and the substrate film 50 are pinched between the print head 22 and the platen roller 44 precisely at the line of printing elements 82. When these elements 82 are heated under electronic control, and the film 50 and ribbon 42 are passed together over the elements 82, ink is transferred from the ribbon 42 to the film 50 so as to print characters and symbols according to pre-programmed information incorporated in the signals fed to the print head 22.

During printing, the ribbon 42 is in contact with film 50 and normally travels at the same speed. This is achieved by mounting an optical shaft encoder on a shaft bearing the platen roller 44. The output of the encoder is representative of the speed of the film 50, and by processing this output signal, the stepper motor 18 driving ribbon drive roller 40 is adjusted such that the ribbon 42 is driven at the correct speed. This synchronization between ribbon 42 and film 50 can be maintained over a wide range of speeds.

The preferred embodiment is capable of operating at a film speed of 400 mm per second.

Figure 4:
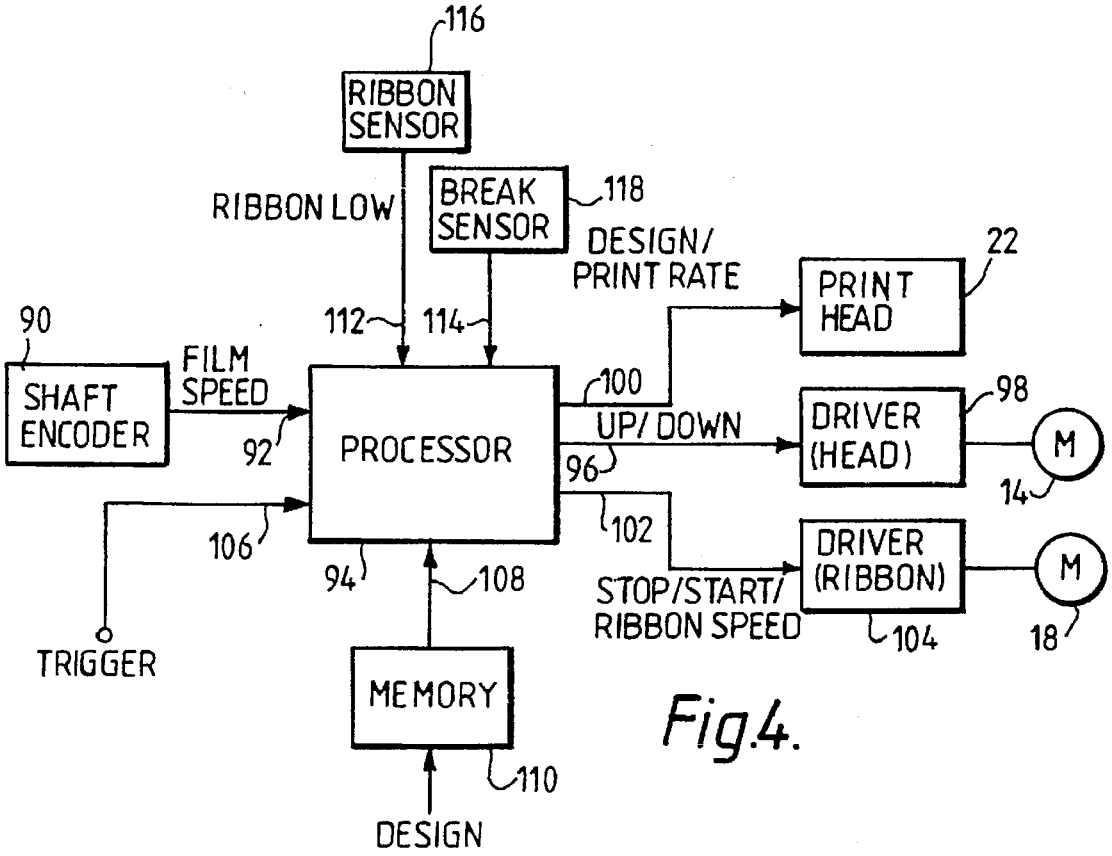
FIG. 4 is a block diagram of electrical parts of the printer.

The shalt encoder associated with the platen roller 44 is shown in FIG. 4 by reference numeral 90. Encoder 90 provides an input signal representative of the film speed to an input 92 of a processor unit 94. The processor unit 94 has at its heart a microprocessor, and has three outputs. These are a first output 96 coupled to a first motor driver circuit 98 for moving the print head 22 between its inactive retracted position and its active extended position (respectively shown in FIG. 2) by means of stepper motor 14 and its associated linkage.

A second output of the processor unit 94 is a multi-wire input 100 coupled to the energizable elements 82 of the print head 22.

The third output 102 is coupled to a second motor driver 104 to control stepper motor 18, thereby stopping and starting the ribbon 42, and controlling the ribbon speed during each printing operation.

Other inputs to the processor include trigger input 106 which receives a trigger signal initiating each printing operation. Typically, the trigger signal is generated by sensing the position of products to which the substrate film 50 is to be applied as packaging, as the products travel along an adjacent conveyer. Another input 108 receives the information to be printed from a memory 110. Thus, on receipt of a trigger signal at input 106, the processor is programmed firstly to move the print head 22 to its extended position, to start the ribbon drive motor 18, and to initiate printing by energizing the elements of the print head 22 in accordance with the information stored in the memory 110 so as to thereby print the information as a pattern or a series of characters.

Whilst the printing operation is progressing, the speed at which the ribbon 42 is driven by means of driver 104 and motor 18 is determined according to the film speed signal input received by the processor at input 92, so as to drive the ribbon 42 at the same speed as the film 50. The rate at which the print head elements 82 are driven, that is, the rate at which the pattern or characters are printed, is also varied by processor unit 94 according to the film speed signal input 92. When the processor 94 senses that all of the information relating to the required design has been supplied from memory 110 and has been fed to the print head 22, it issues a stop signal to the ribbon driver 104 to stop ribbon travel, and the driver 98 for the print head motor 14 receives a signal causing the motor 14 to withdraw the print head 22 to its retracted, inactive position. The processor 94 then waits for the next trigger signal at input 106 before repeating the above process. Further inputs 112 and 114 of the processor 94 are called respectively to a ribbon status sensor 116 and a ribbon break sensor 118 which are respectively associated with a spring loaded pivotable arm 120, seen in FIG. 3. This arm 120 has a roller 122 at its distal end contacting the periphery of the ribbon supply on ribbon feed spool 36, so that when the ribbon supply runs low, an alarm can be activated and/or operation of the packaging apparatus of which the printer is part can be halted. Similarly, the break sensor 118 is responsive to excessive clockwise movement of arm 60 (see FIG. 3) to sense breakage of the ribbon 42 which, during normal operation, keeps roller 58 approximately in the position shown in FIG. 3.

Further details of the preferred printer in accordance with the invention will now be described. Limits on the movement of print head carrier 20 and print head 22 are determined firstly by the striking of the print head elements 82 against the platen roller 44 (see FIG. 2) through the ribbon 42 and film 50, and, in the retractive position, by an adjustable stop (not shown) associated with the semi-circular plate 28 behind the front plate 16 of the base unit 10.

Figure 5:
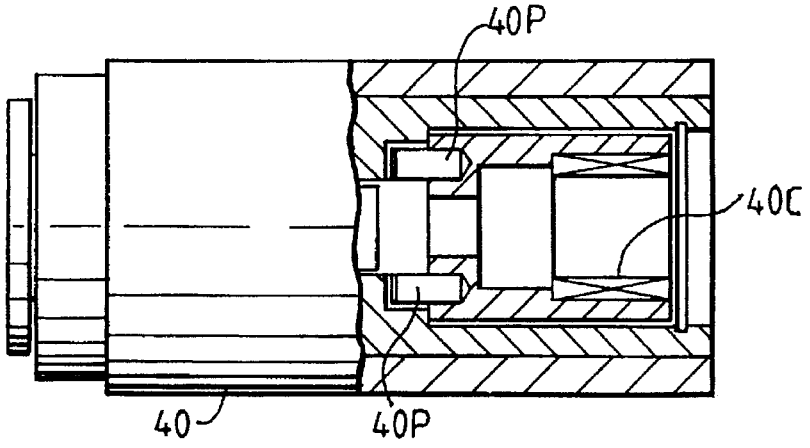
FIG. 5 is a plan view of a ribbon drive roller for the printer of FIG. 1.

Drive to the ribbon drive roller 40, which, it will be seen, is mounted on the cassette front plate 38, is transferred from the base unit 10 to the roller 40 by means of drive spindle 32 shown in FIG. 1. Referring to FIG. 5, roller 40 contains a clutch bearing 40C which is so mounted within the roller 40 that it is allowed to float in the sense that the centre of bearing 40C need not coincide exactly with the centre of the roller 40. When the cassette unit 12 is mounted on base unit 10, the drive shaft or spindle 32 attached to ribbon drive motor 18 (see FIG. 1) enters clutch bearing 40C (FIG. 3). Needle rollers of the clutch bearing, which are self-locking when driven in one rotary direction, engage the outer surface of shaft or spindle 32 and drive is transferred from spindle 32 to the bearing 40C and thence by means of pins 40P to the roller 40. The floating nature of the clutch bearing 40C within the roller 40 allows for a degree of mismatch between the axis 128 of drive spindle 32 and the axis 130 of roller 40 when the cassette unit 12 is mounted on the base unit 10.

The cassette unit 12 is located on base unit 10 by means of a retention pin 132 and a tubular socket 134, as shown in FIG. 1.

Figure 6:
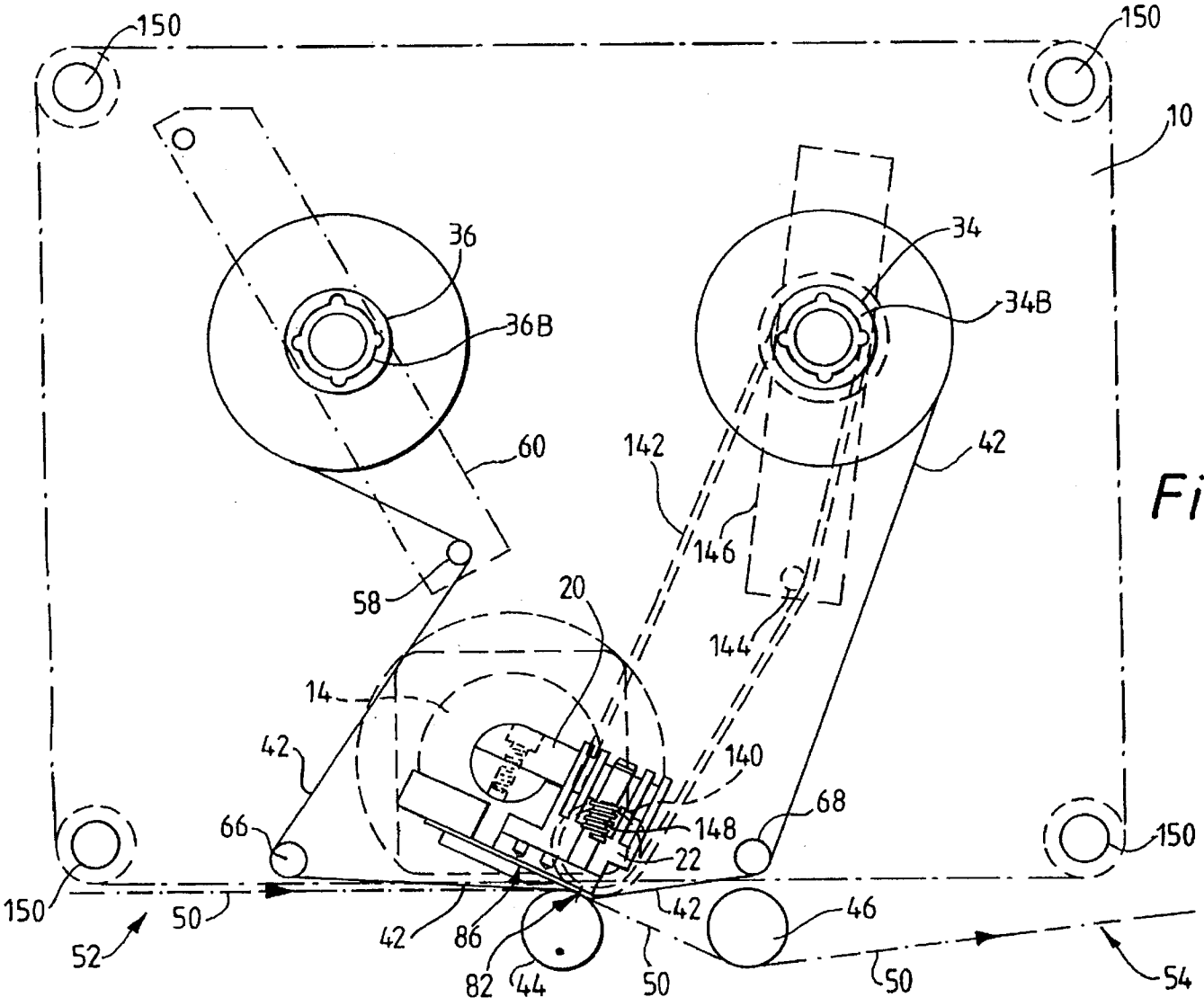
FIG. 6 is a diagrammatic front view of an alternative printer in accordance with the invention.

An alternative embodiment is shown in FIG. 6. In many respects this alternative printer corresponds to that shown in FIGS. 1, 2, and 3, and corresponding parts are correspondingly numbered in FIG. 6. FIG. 6 is diagrammatic in the sense that it is a front view of the printer base unit 10 with certain components of the ribbon cassette unit shown superimposed so that the interaction of both units can be seen.

In this alternative embodiment, the primer has no ribbon drive roller. Instead, synchronization of the ribbon travel and ribbon speed with film travel and film speed is achieved solely by frictional contact between the ribbon 42 and film 50 between the print head 22 and platen roller 44. This frictional contact is sufficient to overcome the resistance to movement of the ribbon 42 presented by the frictional bearing mounting 36B of feed spool 36 and the frictional resistance produced by break detector roller 58 and roller 66 defining the ribbon path upstream of the print head 22. Drive for the take-up spool 34 is derived from a roller 140 (shown in dotted lines in FIG. 6) which is mounted on the print head carrier 20 in such a position that it contacts the substrate film 50 alongside the ribbon 42. Indeed, film 50 is pinched between drive roller 140 and platen roller 44. A pulley (not shown) is mounted for rotation with roller 140 and a belt 142 is threaded around this pulley so as to transfer rotational drive to the take-up spool 34. As in the embodiment of FIGS. 1 and 2, there is a clutch element between the shaft driven by belt 142 and spool 34 to allow the speed of rotation of spool 34 to vary as the diameter of the taken up ribbon increases with use of the ribbon 42. By taking belt drive for the takeup spool 34 directly from substrate film 50, the applicants have, in this second embodiment, dispensed with the need for a ribbon drive motor and the floating beating arrangement of FIG. 5. The drive belt 142 for the ribbon take-up spool 34 is tensioned by means of a roller 144 mounted at the end of an arm 146 which pivots about the bearing 34B of the spool 34 and is spring-loaded so as to be biased in the counter-clockwise direction as seen in FIG. 6.

Other differences which the second embodiment exhibits, compared with the embodiment of FIGS. 1, 2, and 3, include the mounting of the print head carrier 20 directly on the output shaft of the print head stepper motor 14, the latter being mounted behind the front plate of the base unit (as shown by dotted lines in FIG. 6). The print head 22 is resiliently mounted on the carrier 20 by means of a coil spring 148.

In this case, tapered positioning pins 150 are attached to the cassette unit front plate and engage in apertures (not shown) in the base unit 10.

What is claimed is:

1. A thermal printer for printing information onto a continuous print medium by ink transfer from a thermal print ribbon, comprising:

means for feeding a print medium within said printer so as to define a print medium path extending between inlet and outlet regions of said printer;

a platen extending transversely with respect to said print medium path and upon one side of said print medium;

a thermal print head having energizable print elements and located in an opposing relationship with respect to said platen upon the other side of said print medium path;

means for feeding a print ribbon within said printer so as to define a print ribbon path which, between said print head and said platen, extends in the same direction as and lies adjacent to said print medium path;

printing actuator means for bringing said print head and said platen together during successive printing operations; and ribbon drive means for driving said ribbon along said ribbon path at variable rates of speed during said printing operations such that the speed of said print ribbon is substantially the same as that of said print medium.

2. A printer according to claim 1, further comprising:

a print medium speed sensor for sensing the speed of said print medium along said print medium path; and control means operatively coupled to said speed sensor for receiving a speed sensor output signal there from and operatively coupled to said ribbon drive means for driving said ribbon drive means at a rate of speed dependent upon said speed sensor output signal.

3. A printer according to claim 2, wherein:

said ribbon drive means comprises a ribbon drive roller operatively connected to a ribbon drive motor; and said control means is operatively connected to said ribbon drive motor so as to cause said ribbon drive motor to be driven at a rate of speed which is dependent upon said sensor output signal.

4. A primer according to claim 1, wherein the ribbon drive means are arranged such that the ribbon is driven by frictional contact with the print medium.

5. A printer according to claim 1, wherein the print medium path is substantially fixed.

6. A printer according to claim 1, wherein:

said platen has a cylindrical surface; and said print medium path extends within said printer such that said print medium is wrapped around said cylindrical surface.

7. A printer according to claim 6, wherein the platen is a roller and wherein the print medium path defining means include a print medium deflector parallel to and adjacent the platen to cause the print medium to wrap around the platen.

8. A printer according to claim 1, wherein the platen is fixed in position and the print head is movable towards and away from the platen in response to operation of the printing actuator.

9. A printer according to claim 8, wherein the print head is mounted in a print head carrier, and wherein the printer further comprises a motor coupled to the print head carrier and operable to drive the carrier and the head in an oscillating motion.

10. A printer according to claim 9, wherein:

said print head is mounted upon said print head carrier which is pivotable about an axis extending transversely with respect to said print medium path; and said print elements are spaced from said transverse axis so as to execute said movement towards and away from said platen along an arcuate locus intersecting said platen.

11. A printer according to claim 1, including a print medium speed sensor, the printing actuator being responsive to an output from the speed sensor.

12. A printer according to claim 2, wherein:

said speed sensor comprises a shaft encoder operatively connected to said platen which comprises a roller positioned with respect to said print medium path so as to be in contact with said print medium as it passes along said path with the surface speed of said roller matching the speed of said print medium.

13. A method of printing on a continuous print medium, comprising the steps of:

providing a printer having a print head with energizable print elements, and a platen such that said print head and said platen are disposed in an opposed relationship with respect to each other;

feeding a print medium to said printer at a continuous feed rate such that said print medium passes between said print head and said platen;

feeding a print ribbon between said print head and said platen such that said print ribbon is fed in the same direction as and adjacent to said print medium at a rate which is variable in response to the rate of speed of said print medium within said printer; and periodically bringing said print head and said platen together, while energizing said print element and with said print ribbon disposed in contact with said print medium, so as to cause transfer of ink from said print ribbon to said print medium during printing operation.

14. A method according to claim 13, wherein:

said movement of bringing said print head and said platen together occurs as movement of said print head while said platen remains fixed in position.

15. A method according to claim 14, wherein the print head is pivoted about an axis extending transversely to the direction of travel of the print medium.

16. A method according to claim 13, further comprising the steps of:

sensing the rate of speed of said print medium; and driving said print ribbon during said printing operation at a rate of speed which is variable in response to said sensed rate of speed of said print medium.

17. A method according to claim 13, wherein the ribbon is driven between the print head and the platen by frictional contact between the ribbon and the moving print medium during the printing operation.

18. A method according to claim 13, wherein:

said print ribbon is driven at a rate of speed which, during each printing operation, is substantially the same as the rate of speed of said print medium.

19. A printer for printing on a continuous print medium by ink transfer from a print ribbon, comprising:

means defining a print medium path through a printer and along which a print medium is conducted;

a platen extending transversely with respect to said print medium path;

a print head located in an opposed relationship with respect to said platen on the side of said print medium path which is opposite from said platen;

means defining a print ribbon path, between said print head and said platen, which runs in the same direction as and lies adjacent to said print medium path, and along which a print ribbon is conducted;

a ribbon take-off spool and a ribbon take-up spool;

a printing actuator operable to bring said print head and said platen together during successive printing operations; and means for conducting said print ribbon along said print ribbon path at a variable rate of speed such that said speed of said print ribbon is substantially the same as that of said print medium.

20. A printer according to claim 19, further comprising:

a ribbon drive pulley located along said ribbon path between said print head and said take-up spool; and a ribbon drive motor operatively coupled to said drive pulley, wherein said take-up spool is belt-driven by said motor through means of a slipping clutch drive.

21. A thermal printer for printing information on a moving web by ink transfer from a thermal print ribbon, comprising:

a frame;

a print head mounted upon said frame and movable between an inactive retracted position and an active extended position, said print head comprising an elongate array of energizable printing elements;

a printing actuator operable to move said print head between said retracted and extended positions;

means defining a ribbon path extending across said print head in a direction transverse to said printing element array and along which a print ribbon is conducted;

means defining a print web path extending across said print head in a direction transverse to said printing element array and along which a print web is conducted;

ribbon drive means for driving said print ribbon along said ribbon path; and electronic control means comprising a web speed sensor input for inputting rate of speed signals of said print web, a printing actuator output for actuating said printing actuator, and a ribbon drive output for driving said ribbon drive means at a rate of speed which is dependent upon a signal received at said web speed sensor input and indicative of said rate of speed of said print web.

22. A printer according to claim 21, wherein:

said print head is pivotable about an axis extending parallel to said array of printing elements; and said printing actuator and said control means are operable so as to cause said print head to oscillate about said axis so as to repeatedly bring said print head into said extended position for respective successive printing operations in which ink is transferred from said print ribbon to said print web whilst both said print ribbon and said print web are moving past said print head and whilst said print head is held stationary at said extended position.

23. A printer according to claim 21, wherein the control means are operable to cause the ribbon drive means to drive the ribbon across the head at the same speed as the rate of travel of the web as indicated by the web sensor input signal.

24. A printer according to claim 21, further comprising:

a roller disposed along said web path extending in the same direction as said ribbon path so as to receive said print web therearound; and a web speed sensor comprising a shaft encoder operatively connected to said roller for providing said web speed sensor input to said electronic control means.

25. A printer according to claim 21, wherein the electronic control means are operable to cause the rate at which the information is printed to vary depending on the signal received at the web speed sensor input.

* * * * *